US005377376A

United States Patent [19]

Wood et al.

[11] Patent Number: 5,377,376

[45] Date of Patent: Jan. 3, 1995

[54] MOBILE SURFACE CLEANING MACHINE

[75] Inventors: David Wood, Rockford; Randy Brunn, Brooklyn Park, both of Minn.

[73] Assignee: Advance Machine Company, Plymouth, Minn.

[21] Appl. No.: 110,362

[22] Filed: Aug. 23, 1993

Related U.S. Application Data

[62] Division of Ser. No. 781,832, Oct. 24, 1991, Pat. No. 5,239,720.

[51] Int. Cl.[6] ..... E01H 1/04

[52] U.S. Cl. ..... 15/83; 15/340.4; 414/707; 414/715

[58] Field of Search ..... 15/83–86, 15/340.3, 340.4; 414/706, 707, 715

[56] References Cited

U.S. PATENT DOCUMENTS

| | | | |
|---|---|---|---|
| 2,614,279 | 10/1952 | Mott . | |
| 3,006,021 | 10/1961 | Patch . | |
| 3,009,590 | 11/1961 | Kampert | 414/715 |
| 3,162,877 | 12/1964 | Schmidt et al. | 414/715 X |
| 3,189,931 | 6/1965 | Peabody . | |
| 3,197,798 | 8/1965 | Brown et al. | 15/340.3 |
| 3,604,051 | 9/1971 | Wendel et al. . | |
| 3,634,900 | 1/1972 | Prescott et al. | 15/84 |
| 3,701,177 | 10/1972 | Meyer et al. . | |
| 3,833,961 | 9/1974 | Fortman et al. | 15/320 |
| 3,879,789 | 4/1975 | Kasper | 15/340.3 |
| 3,918,118 | 11/1975 | vom Berg et al. . | |
| 4,037,289 | 7/1977 | Dojan . | |
| 4,041,567 | 8/1977 | Burgoon . | |
| 4,099,285 | 7/1978 | Christensen et al. . | |
| 4,158,901 | 6/1979 | Wulff et al. . | |
| 4,160,303 | 7/1979 | Hasenpath et al. . | |
| 4,173,052 | 11/1979 | Burgoon et al. . | |
| 4,327,455 | 5/1982 | Burgoon . | |
| 4,355,946 | 10/1982 | Wykhuis et al. | 414/707 |
| 4,363,152 | 12/1982 | Karpanty . | |
| 4,369,540 | 1/1983 | Burgoon et al. . | |
| 4,429,433 | 2/1984 | Burgoon . | |
| 4,464,810 | 8/1984 | Karpanty . | |
| 4,580,313 | 4/1986 | Blehert . | |
| 4,731,956 | 3/1988 | Wood . | |
| 4,805,258 | 2/1989 | Sitarski et al. . | |
| 4,895,476 | 1/1990 | Vangaever . | |
| 5,044,043 | 9/1991 | Basham et al. | 15/98 |

*Primary Examiner*—Edward L. Roberts

*Attorney, Agent, or Firm*—Peterson, Wicks, Nemer & Kamrath

[57] ABSTRACT

A surface cleaning machine (10) is disclosed in the preferred form as a combination sweeping-scrubbing apparatus including a sweeping brush (18) for sweeping debris into a hopper (20) and a one piece squeegee (112) for picking up solution after four staggered, disc brushes (122). The squeegee (112) is U-shaped having a longitudinal extent greater than that of the disc brushes (122) located intermediate the legs (124) of the squeegee (112). The drive wheel (16) is located in front of the disc brushes (122), the squeegee (112) and the solution applying means (128). The squeegee (112) is raised and lowered relative to the frame (12) by an actuator (104) which pivots an L-shaped member (94), the leg (96) of which abuts against and pivots a lever (84) interconnected to the mount (62) for the squeegee (112) by a turnbuckle (88). The hopper (20) is raised and simultaneously tilted by a single cylinder (30) which pivots the upper arm (24) of a parallelogram including a lower arm (36). The hopper (20) is pivotally mounted to an end of a hopper arm (48), the opposite end of which is pivotally mounted to the end of the upper arm (24), and is further pivotally mounted to the end of the lower arm (36). The hopper (20) is simultaneously tilted at a generally constant dump angle as the hopper (20) is raised from a lowered position in a horizontal debris collecting condition to a raised position with the hopper (20) in a dumping condition.

20 Claims, 3 Drawing Sheets

MOBILE SURFACE CLEANING MACHINE

This is a divisional of copending application(s) Ser. No. 07/781,832 filed on Oct. 24, 1991, now U.S. Pat. No. 5,239,720.

BACKGROUND

The present invention generally relates to mobile surface cleaning machines, particularly to mobile floor surface cleaning machines, and specifically to surface cleaning machines having the ability to dump debris from its hopper at multiple levels above the surface and to surface cleaning machines having a plurality of longitudinally staggered brushes positioned within the longitudinal extent of a one piece, U-shaped squeegee.

Surfaces such as floors are often cleaned by sweeping and by scrubbing, with machines being available to perform both in a single operation. During sweeping, a drum brush is rotated to sweep the surface over which the machine passes throwing debris into a hopper. It can then be appreciated that it becomes necessary to empty the hopper periodically to allow continued collection of debris. Although various hopper dumping mechanisms have been utilized, shortcomings exist such as but not limited to the ability to dump the hopper at various heights according to the particular debris storage utilized and to the complexity of construction and operation of the dumping mechanism. Thus, a need exists for apparatus and methods for dumping hoppers of cleaning machines overcoming the shortcomings of prior mechanisms.

To scrub floors, streets, parking lots and the like, cleaning machines commonly use multiple disc-like scrub brushes rotating in a horizontal plane to loosen dirt and grime from the surface to be cleaned. A water/-soap solution is often used to enhance the cleaning action of the scrub brushes. As the machine moves forward a vacuumized squeegee tool follows behind the scrub brushes and suctions the water/soap solution left by the brushes and deposits the solution into a holding tank. The cleaned surface is left dry enough to allow the flow of traffic to continue uninterrupted. Suitable provisions must be provided for picking up the dirty solution when the scrubber is turned or goes around corners. One approach is to extend the squeegee past the combined width of the scrub brushes. However, this approach prevents the machine from scrubbing close to walls, curbs, or similar abutments. Another approach is to utilize generally longitudinally extending, auxiliary wiping blades to channel the dirty solution on the surface into the squeegee. However, this approach significantly increases the component cost for the wiping blades themselves as well as the mechanism for raising and lowering the wiping blades relative to the surface. Further, such wiping blades are especially prone to damage from engaging non-moveable objects such as door stops, ridges, or the like. Thus a need exists for apparatus and methods for picking up the dirty solution overcoming the shortcomings of prior approaches.

Scrubbing machines of this type are generally self-propelled because of their considerable size and weight. The method of propulsion most commonly employed is a single drive wheel located toward the rear of the machine and approximately centered laterally. Two non-driven wheels are typically located toward the front of the machine, one wheel on each side toward the outside edge of the machine. In machines currently commercially available, the drive wheel is located between the scrub brushes and the vacuumized squeegee tool. An obvious disadvantage of this particular arrangement is that the drive wheel must move through the water/soap path left behind the scrub brushes before the solution can be suctioned up by the squeegee tool. The water/soap solution significantly reduces the coefficient of friction between the drive wheel and the surface being cleaned. This can result in loss of traction, swerving, sliding, and loss of control. Thus, a need also exists for apparatus and methods for eliminating the problem of drive wheels moving through the solution path left behind by the scrub brushes.

SUMMARY

The present invention solves these needs and other problems in the cleaning of surfaces such as those of floors, streets, parking lots and the like, by providing in the preferred form and in a first aspect of the present invention, means for simultaneously tilting the hopper at a generally constant dump angle as the hopper is raised relative to the frame from a lowered position with the hopper in a horizontal cleaning condition to a raised position with the hopper in a dumping condition to allow dumping of the debris from the hopper at multiple levels above the floor surface.

In another aspect of the present invention, the plurality of longitudinally staggered scrubbing brushes are located intermediate the first and second legs of a one piece, U-shaped squeegee, with the free ends of the first and second legs extending beyond the longitudinal extent of the brushes. In a most preferred form, the drive wheel for the machine is located longitudinally in front of the brushes and the squeegee and before the cleaning solution is applied to the surface so that the drive wheel travels through a dry path.

It is thus an object of the present invention to provide a novel mobile surface cleaning machine.

It is further an object of the present invention to provide such a novel surface cleaning machine having the ability to dump the hopper at multiple levels.

It is further an object of the present invention to provide such a novel surface cleaning machine which simultaneously tilts the hopper at a constant dump angle as the hopper is being raised.

It is further an object of the present invention to provide such a novel surface cleaning machine having a dumping mechanism of simple construction and operation.

It is further an object of the present invention to provide such a novel surface cleaning machine which eliminates operator error in the dumping of the hopper.

It is further an object of the present invention to provide such a novel surface cleaning machine having a uniquely configured squeegee arranged with the scrubbing brushes to entirely cover the path of the brushes even on sharp turns.

It is further an object of the present invention to provide such a novel surface cleaning machine having a mechanism for picking up solution from the floor of simple construction and operation.

It is further an object of the present invention to provide such a novel surface cleaning machine for scrubbing floors with a cleaning solution having the wheels traveling through a dry path before the squeegee.

It is further an object of the present invention to provide such a novel surface cleaning machine eliminating the requirement for auxiliary wiper blades.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 2:
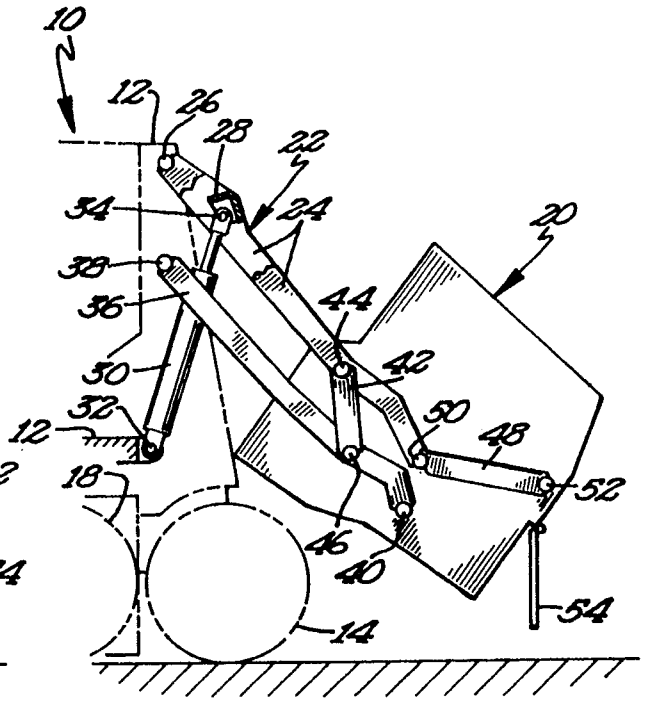
FIGS. 2—4 show partial, side views of the mobile surface cleaning machine of FIG. 1 with the hopper raised relative to the frame at various levels above the surface.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "end", "longitudinal", "lateral", "forward", "rearward", "raised", "lowered", and similar terms are used herein, it should be understood that these terms have reference only to the structure shown in the drawings as it would appear to a person viewing the drawings and are utilized only to facilitate describing the invention.

DESCRIPTION

A surface cleaning machine according to the preferred teachings of the present invention is shown as a combination sweeping-scrubbing apparatus in the drawings and generally designated 10. Machine 10 generally includes a body or frame 12 having forward wheels 14 and a single, steerable, rear drive wheel 16 for providing mobility and moveability about the surface to be cleaned. Machine 10 further includes a sweeping brush 18 rotatable about a transverse axis in a direction opposite to the forward movement direction of machine 10 to move dust and debris from the surface to be swept (i.e., a floor, street, parking lot, or the like) toward and into a collector and filter hopper 20 as machine 10 travels in the forward movement direction, with hopper 20 holding the dust and debris collected from the surface being cleaned.

In the most preferred form of the present invention, machine 10 includes a linkage assembly 22 for raising and lowering hopper 20 relative to frame 12 allowing the contents of hopper 20 to be dumped out at any height between one foot (30 centimeters) and 5 feet (150 centimeters). Particularly, linkage assembly 22 includes on each side of machine 10, an upper arm 24 having a first end pivotably mounted to frame 12 by pivot pin 26 and a second end. In the most preferred form, upper arms 24 on the opposite sides of machine 10 are connected together by a cross brace 28 at a location longitudinally spaced from pivot pins 26. A single, double acting hydraulic cylinder 30 has a first end pivotably mounted to frame 12 by pivot pin 32 and a second end pivotably mounted to cross brace 28 intermediate arms 24 by pivot pin 34 for pivoting arms 24 relative to frame 12 about pivot pins 26.

Linkage assembly 22 further includes members for operatively connecting hopper 20 to the second ends of arms 24 for raising and simultaneously tilting hopper 20 as first arms 24 are raised relative to frame 12 by cylinder 30. In the most preferred form, a lower arm 36 is provided of a length slightly shorter than arms 24 and in the preferred form approximately 90% of the length of arms 24. Each of arms 36 on each side of machine 10 have a first end pivotably mounted to frame 12 by pivot pin 38 and a second end pivotably mounted to hopper 20 by pivot pin 40, with pivot pins 38 being spaced below and parallel to pivot pins 26. A rotation arm 42 is provided on each side of machine 10 having a first end pivotably mounted to upper arm 24 by pivot pin 44 and a second end pivotably mounted to lower arm 36 by pivot pin 46. The length of rotation arm 42 between pivot pins 44 and 46 is less than the spacing between pivot pins 26 and 38 of frame 12. Pivot pin 44 is located intermediate pivot pin 26 and the second end of upper arm 24 and in the preferred form is located approximately 70% of the length of upper arm 24 from pivot pin 26. Pivot pin 46 is located intermediate pivot pins 38 and 40 and in the preferred form is located approximately 75% of the length of lower arm 36 from pivot pin 38. A hopper arm 48 is provided on each side of machine 10 having a first end pivotably mounted to the second end of upper arm 24 by pivot pin 50 and a second end pivotably mounted to hopper 20 by pivot pin 52 for operatively connecting hopper 20 to the second end of upper arms 24, with pivot pins 50 being spaced above and parallel to pivot pins 40.

Figure 1:
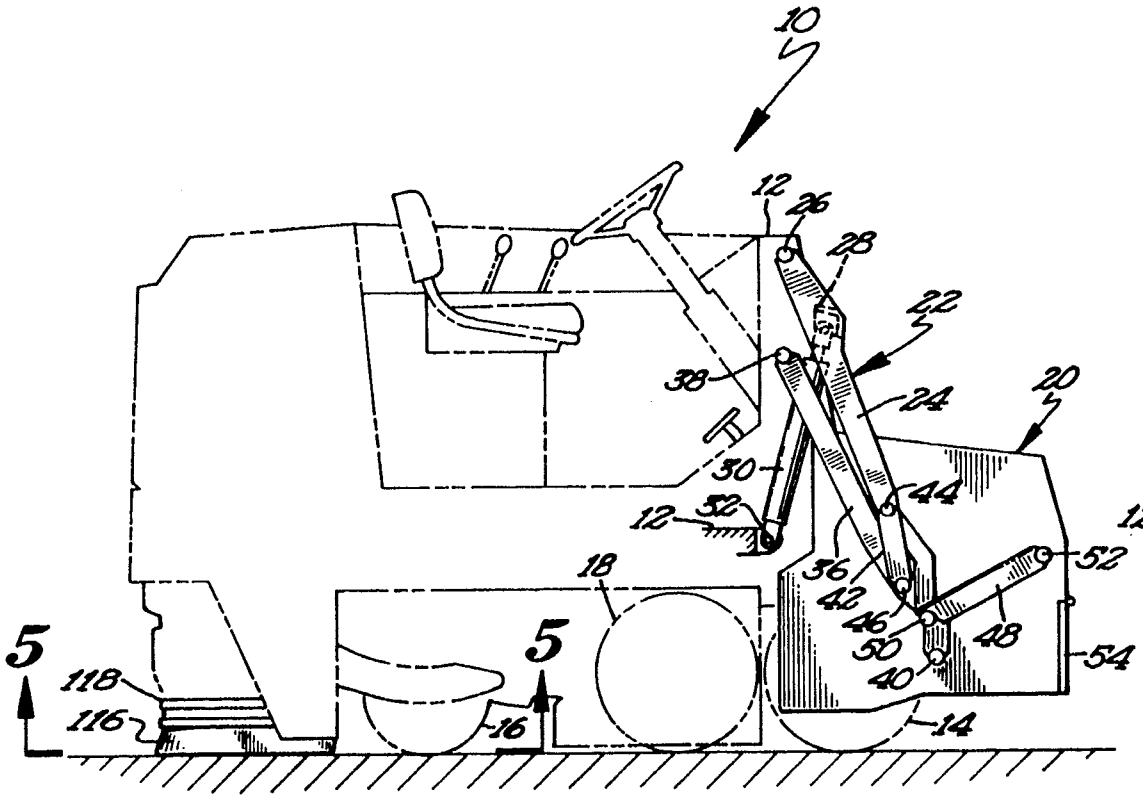
FIG. 1 shows a side view of a mobile surface cleaning machine according to the preferred teachings of the present invention, with portions shown in phantom and with the hopper shown in its lowered position and in a horizontal cleaning condition relative to the frame.

It can then be appreciated that arms 24, 36, and 42 and frame 12 between pivot pins 26 and 38 generally form a moveable parallelogram, with movement effected by the extension and retraction of cylinder 30. Particularly, with cylinder 30 in its retracted condition, arms 24 and 36 are generally in a lowered, abutting position extending vertically downward from pivot pins 26 and 38. In the most preferred form, arm 24 includes a V-shaped bend adjacent pivot pin 50 to allow pivot pins 38, 40, 46 and 50 to be arranged generally linearly in the lowered position. Additionally, hopper arm 48 holds hopper 20 in a generally horizontal debris collecting condition relative to frame 12 as best seen in FIG. 1.

With the extension of cylinder 30, the spacing between arms 24 and 36 and between pivot pins 40 and 50 increases. It can then be appreciated that as hopper 20 is raised, pivot pin 50 will move about an arc such that hopper 20 connected to pivot pin 50 through hopper arm 48 will pivot about pivot pin 40 to a tilted condition at a dump angle in the order of 60°, with the forward end of hopper 20 opposite frame 12 being positioned below the rearward end of hopper 20 adjacent frame 12 in the preferred form as best seen in FIG. 2. In the preferred form shown, hopper 20 reaches its fully tilted condition with only a 1 to 1½ inch (2.5 to 3.8 centimeters) extension of cylinder 30 out of a 16 inch (40 centimeters) total extension of cylinder 30 or in other words between 6.25 to 9.38% of the total extension of cylinder 30.

Figure 3:
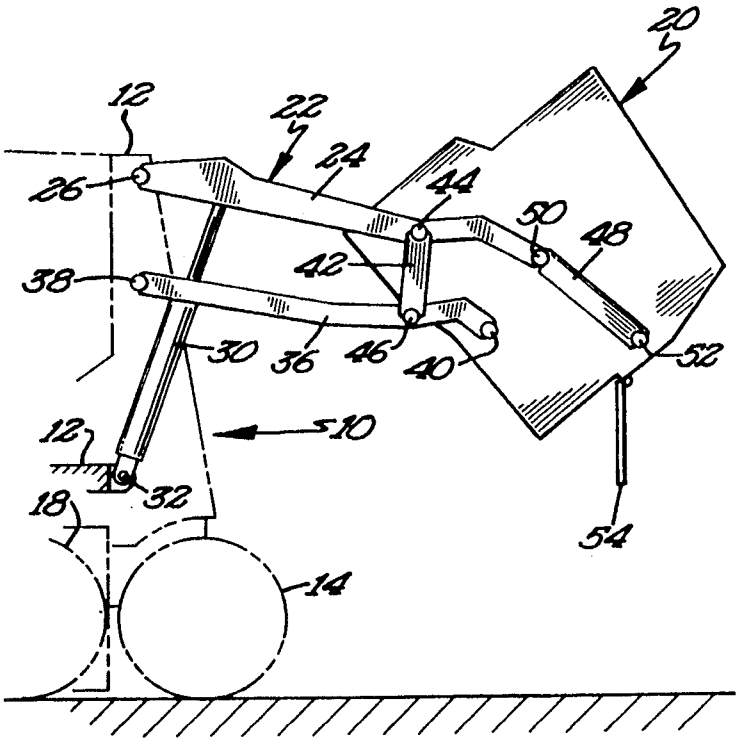
Figures 5, 6, 7:
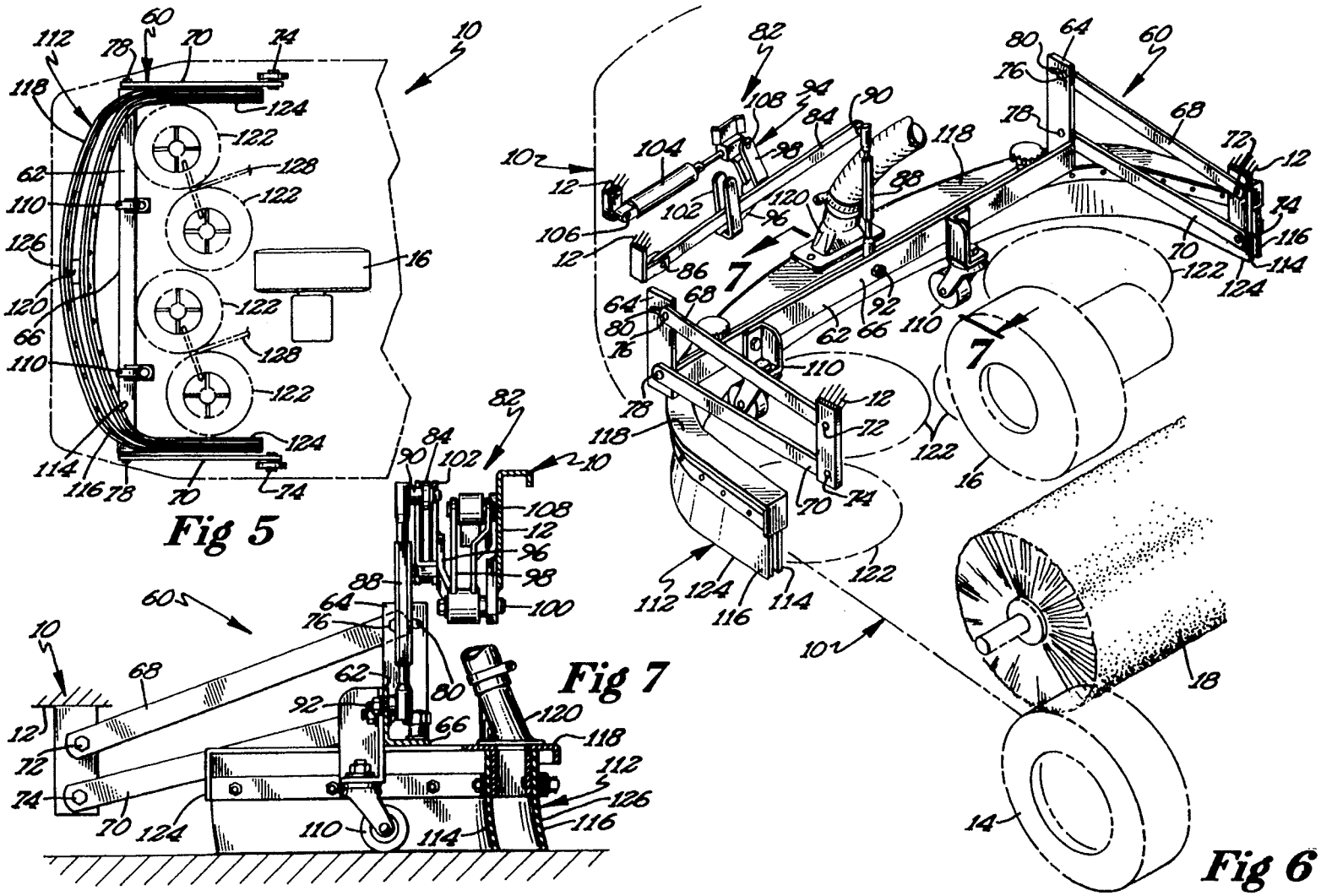
FIG. 5 shows a cross sectional view of the mobile surface cleaning machine of FIG. 1 according to section line 5—5 of FIG. 1, with portions being shown in phantom.
FIG. 6 shows a partial, perspective view of the mobile surface cleaning machine of FIG. 1, with portions being shown in phantom.
FIG. 7 shows a cross sectional view of the mobile surface cleaning machine of FIG. 1 according to section line 7—7 of FIG. 6.

With continued extension of cylinder 30, the spacing between arms 24 and 36 and between pivot pins 40 and 50 increases until rotation arm 42 is generally parallel to the portion of frame 12 intermediate pivot pins 26 and 38. However, as best seen in FIG. 3, it should be noted that due to the arcuate path of pivot pin 50, hopper 20 will be held at the same tilt or dump angle by hopper arm 48 as when hopper 20 is initially tilted as shown in FIG. 2.

Figure 4:
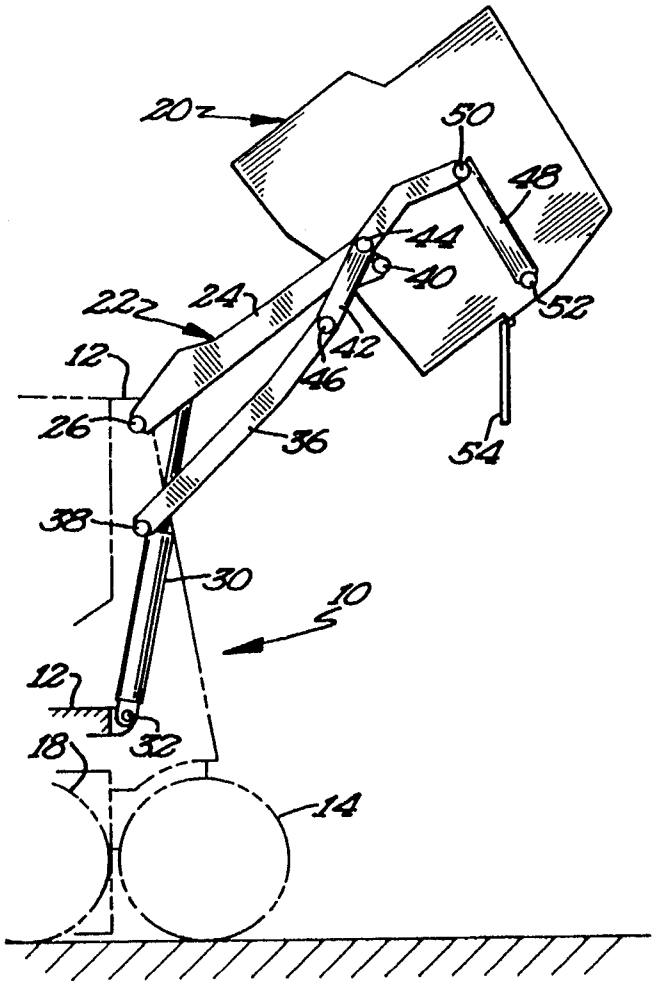

With continued extension of cylinder 30, the spacing between arms 24 and 36 and between pivot pins 40 and 50 decreases until arms 24 and 36 are generally in a raised, abutting position extending vertically upward from pivot pins 26 and 38 as best seen in FIG. 4. In the most preferred form, arm 36 includes a V-shaped bend adjacent pivot pin 40 to allow pivot pins 38, 40, 46 and 50 to be arranged generally linearly in the raised position. It should be noted that due to the arcuate path of pivot pin 50, hopper 20 will be held at the same tilt or dump angle by hopper arm 48 as when hopper 20 is initially tilted as shown in FIG. 2 and all intermediate positions including that shown in FIG. 3.

In the most preferred form of the present invention, hopper 20 includes a door 54 located in the forward end thereof opposite frame 12 and remotely openable and closable by any suitable means by the operator riding in frame 12. It can be appreciated that the contents of hopper 20 will slide forward under gravitational forces towards door 54 when hopper 20 is tilted in a manner as shown in FIGS. 2–4. It can further be appreciated that the contents of hopper 20 can be dumped at any height between one foot (30 centimeters) and five feet (150 centimeters) by the operator opening door 54 at the desired height, with hopper 20 being fully tilted at all raised positions. Thus, the contents of hopper 20 can be dumped generally at floor level as shown in FIG. 2 without the contents falling a great distance and being subjected to drifting and/or winds, can be dumped in a garbage can as shown in FIG. 3, and can be dumped in a dumpster or the like as shown in FIG. 4.

It should further be appreciated that lifting and tiling hopper 20 is combined into a single process, i.e. the raising and lowering of upper arm 24, which in the most preferred form is accomplished by single cylinder 30. The use of a single process eliminates problems and is otherwise advantageous over separate lifting and tilting processes. Particularly, the use of separate processes requires multiple hydraulic cylinders, hoses, fittings, controls, and other associated components which increase the expense for prior cleaning machines. Machine 10 according to the preferred teachings of the present invention utilizes only a single cylinder 30 reducing costs over multi-process machines. Additionally, the use of separate processes often required operator control, resulting in operator error. For example, the operator had to determine when the hopper had cleared the chassis and was safe to tilt. If the hopper had not sufficiently cleared the chassis when tilting occurred, the hopper was dented or bent out of shape such that gaskets for dust control did not seal. Machine 10 according to the preferred teachings of the present invention utilizing only single cylinder 30 eliminates operator error as hopper 20 is automatically raised and tilted together with a single control. Also, machine 10 according to the preferred teachings of the present invention allows ease of operation. For example, an operator can quickly tilt hopper 20 such as when a large piece of debris can not get under the lip of hopper 20 to be swept by brush 18. Specifically, hopper 20 can quickly be raised and lowered to get the debris into brush 18 while machine 10 is sweeping, leading to greater productivity.

Machine 10 in the most preferred form further includes a squeegee assembly 60 for picking up dirty solution from the floor surface. Particularly, assembly 60 includes a mount 62 of a U-shape including vertical ends 64 upstanding from the opposite ends of a central portion 66. Two pairs of generally parallel links are utilized to secure mount 60 for movement between a raised position and a lowered position. Each pair of links includes an upper link 68 and a lower link 70. The forward ends of links 68 and 70 are pivotably mounted to frame 12 about spaced pivot pins 72 and 74. The rearward ends of links 68 and 70 are pivotably mounted to ends 64 about spaced, pivot pins 76 and 78. In the most preferred form, pivot pins 76 are adjustably secured through an arcuate slot 80 to permit adjustment for manufacturing tolerances such that mount 62 and squeegee assembly 60 is generally parallel to the surface to be cleaned when frame 12 is moved along the surface. In the most preferred form, the spacing between pivot pins 72 and 74 is less than the spacing between pivot pins 76 and 78 to allow ends 64, mount 62, and squeegee assembly 60 to travel along an arc from an intermediate position to permit squeegee assembly 60 to remain in contact with the surface as the machine travels over the edge of an incline such as the top of a ramp.

Machine 10 according to the preferred teachings of the present invention includes provisions 82 for raising and lowering mount 62 between its raised and lowered positions. Specifically, provisions 82 include a lever 84 having a first end pivotably mounted to frame 12 about pivot pin 86. A turnbuckle 88 has its upper end pivotably connected to the second end of lever 84 by pivot pin 90 and its lower end pivotably connected to central portion 66 intermediate ends 64 by pivot pin 92. Provisions 82 further include a generally L-shaped member 94 including first and second legs 96 and 98 interconnected together by their first ends at a fixed angle. Member 94 is pivotably mounted to frame 12 about a pivot axis 100 extending through the first ends of legs 96 and 98 parallel to pivot pin 86. A U-shaped member 102 is secured to the second, free end of leg 96. Lever 84 is slideably received between the upstanding legs of U-shaped member 102. A linear actuator 104 has a first end pivotably mounted to frame 12 by a pivot pin 106 and a second end pivotably mounted to the second, free end of leg 98 by a pivot pin 108, with pins 106 and 108 being parallel to and spaced from pins 86, 90, and 100. It can be appreciated that when actuator 104 is extended, L-shaped member 94 will pivot about pivot axis 100 causing the second, free end of leg 96 and U-shaped member 102 to raise vertically. Leg 96 and member 102 abut with lever 84 causing lever 84 to pivot upwardly about pivot axis 86, with the upstanding legs of U-shaped member 102 preventing lever 84 from sliding off the second, free end of leg 96. Upward movement of lever 84 causes mount 62 to be raised due to the interconnection of turnbuckle 88 therebetween, with ends 64 moving generally vertically due to the pivotal connection of links 68 and 70. Similarly, when actuator 104 is retracted, the above process is reversed causing mount 62 to be lowered.

In the most preferred form, mount 62 includes first and second casters 110 secured at spaced locations on central portion 66. In the raised position of mount 60, casters 110 do not engage the surface whereas in the lowered position of mount 60, casters 10 engage the surface providing rolling support of mount 60 on the surface to be cleaned. In the most preferred form, during the cleaning mode of machine 10, actuator 104 is retracted to an extent such that the second, free end of leg 96 is spaced from lever 84 which is supported through turnbuckle 88 by mount 60 in turn supported by casters 110, with the upstanding legs of U-shaped member 102 preventing lever 84 from moving out of alignment with the second, free end of leg 96. Thus, it can be appreciated that mount 62 is allowed to float relative to L-shaped member 94 to follow irregularities in the surface to be cleaned when frame 12 is moved along the surface regardless of the unevenness of the surface. Specifically, it is not necessary to continuously adjust actuator 104 during operation of machine 10 to insure that the cleaning process engages the surface at all times.

It can also be appreciated that provisions 82 are particularly advantageous for several reasons including but not limited to its compact vertical and longitudinal extent, its simplicity of design and operation, and its ability to float to follow irregularities in the surface being cleaned.

In the preferred form, squeegee assembly 60 includes a squeegee 112 which aside from its shape can be of any conventional construction. Generally, squeegee 112 includes first and second flexible blades 114 and 116 removably secured to a mounting member 118 by any suitable means. A vacuum chamber is formed and defined by blades 114 and 116, mounting member 118, and the surface to be cleaned, with the ends of blades 114 and 116 abutting with each other to close the ends of the vacuum chamber. An inlet 120 is in fluid communication with the vacuum chamber of squeegee 112 and a source of vacuum carried by frame 12. In the most preferred form, mounting member 118 of squeegee 112 is removably connected to mount 62 in a manner as shown and described in U.S. Pat. No. 4,363,152.

Machine 10 in the preferred form of the present invention further includes a plurality of rotary disc brushes 122 carried by frame 12 and located behind drive wheel 16 in a staggered relationship so that the path covered by each of brushes 122 slightly overlaps the path of the adjacent brush or brushes 122 as shown in U.S. Pat. No. 4,158,901, with first, second, third, and fourth brushes 122 being shown in the most preferred form. Particularly, the second brush 122 is located intermediate the first and third brushes 122 and the third brush 122 is located intermediate the second and fourth brushes 122, with the first and third brushes 122 being at the same longitudinal position and the second and fourth brushes 122 being at the same longitudinal position spaced from the longitudinal position of the first and third brushes 122. The combined path of brushes 112 extends substantially over the width of frame 12. Cleaning solution from a supply tank carried by frame 12 can be supplied to the surface being cleaned in a known manner behind drive wheel 16 and through or near brushes 122. In the most preferred form, the solution application means 128 includes manifolds secured to the underside of the gear cases for brushes 122 and connected to a valve in turn connected to the supply tank. When the valve is opened, the cleaning solution flows under gravitation forces onto the back of brushes 122 adjacent the center of the hub for brushes 122 which include holes in fluid communication with the center hole of the back of brushes 122.

It should be noted that the use of four brushes 122 in the preferred form of the present invention as opposed to three brushes commonly utilized in scrubbing machines such as disclosed in U.S. Pat. No. 4,363,152 reduces the longitudinal extent of brushes 122 as the diameters of brushes 122 are reduced to approximately 70% of the diameters of prior three brush arrangements.

It can be further appreciated that positioning brushes 122 intermediate drive wheel 16 and squeegee 112 and with the solution applying means generally within the longitudinal extent of brushes 122 and generally intermediate drive wheel 16 and squeegee 112 or in other words with drive wheel 16 located in front of brushes 122 and the solution application means 128 is particularly advantageous. In current scrubbing machines such as disclosed in U.S. Pat. No. 4,363,152, the drive wheel was positioned behind the scrubbing brushes, with the center scrubbing brush being staggered in front of the two outside scrubbing brushes and the drive wheel being at the same longitudinal axis as the center brush and within the lateral extent of the outside scrubbing brushes. An obvious disadvantage of this prior arrangement is that the drive wheel must move through the solution left behind the scrub brushes before the solution can be suctioned up by the squeegee tool. The solution which typically includes a soap significantly reduces the coefficient of friction between the drive wheel and the surface being cleaned which can result in loss of traction, swerving, sliding, and loss of control. In the preferred form of the present invention, brushes 122 and the solution applied to the surface are behind drive wheel 16 so that drive wheel 16 travels through a dry path and avoids the problems of the reduced coefficiency of friction encountered by prior scrubbing machines.

Squeegee 112 according to the preferred teachings of the present invention is of a one piece design configured so that it entirely covers the path of brushes 122 even on sharp turns. Specifically, squeegee 112 is generally U-shaped having a longitudinal extent greater than the longitudinal extent of brushes 122. Particularly, squeegee 112 includes first and second legs 124 integrally extending forwardly from the opposite ends of a central portion 126. Legs 124 are generally planar having a longitudinal extent generally equal to and in the most preferred form slightly less than and being generally longitudinally coextensive with brushes 122, with the forward, free ends of legs 124 of squeegee 112 extending beyond the forward most part of brushes 122. Legs 124 are generally parallel to each other and located on opposite sides of brushes 122, with brushes 122 located in squeegee 112 intermediate legs 124. Central portion 126 is of a large diameter arcuate shape, with inlet 120 located at the center of central portion 126. Legs 124 extend along a chord of the arcuate shape of central portion 126. It can be appreciated that the configuration of squeegee 112 according to the preferred teachings of the present invention eliminates the requirement for auxiliary wiping blades such as those shown in U.S. Pat. No. 4,037,289 to channel solution into the squeegee to recover solution when the scrubbing machines are turned. Due to their elongated longitudinal extent, such auxiliary wiping blades were prone to breakage. Further, in addition to the elimination of the auxiliary wiping blades themselves, the lifting mechanisms and controls for such auxiliary wiping blades are also eliminated in machine 10 according to the most preferred teachings of the present invention to reduce the component costs and assembly. It can also be appreciated that the U-shape of squeegee 112 allows the rear corners of frame 12 of machine 10 to be beveled making sharp turns possible in a narrower aisle such as in warehouses or factories.

Now that the basic teachings of the present invention have been explained, many extensions and variations will be obvious to one having ordinary skill in the art. For example, although hopper 20 is shown in a forward tilt angle when in a raised position, machine 10 according to the teachings of the present invention can include provisions for tilting hopper 20 at a reverse angle in a raised position.

Likewise, although machine 10 in its most preferred form is shown as a combination sweeping-scrubbing apparatus, it can be appreciated that machine 10 can be constructed including only one of such cleaning processes.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Machine for movement along a surface having debris comprising, in combination: a frame; a hopper for holding debris collected from the surface; and means for raising the hopper relative to the frame from a lowered position with the hopper in a horizontal debris collecting condition to a raised position with the hopper in a dumping condition and for simultaneously tilting the hopper as the hopper is raised from the lowered position to allow dumping of the debris from the hopper at multiple levels above the surface comprising, in combination: a first arm having a first end pivotally mounted to the frame and a second end; means for pivoting the first arm relative to the frame about the first end; means for operatively connecting the hopper to the second end of the first arm for raising and simultaneously tilting the hopper as the first arm is raised relative to the frame by the pivoting means comprising, in combination: a second arm having a first end pivotally mounted to the frame spaced from the first end of the first arm and having a second end pivotally mounted to the hopper; and a rotation arm having a first end pivotally mounted to the first arm intermediate the first and second ends and having a second end pivotally mounted to the second arm intermediate the first and second ends.

2. The machine of claim 1 wherein the operatively connecting means comprises, in combination: a hopper arm having a first end pivotally mounted to the second end of the first arm and a second end pivotally mounted to the hopper spaced from the second end of the second arm.

3. The machine of claim 2 wherein the hopper has an end opposite the frame and an end adjacent the frame, with the end opposite the frame including a dumping door, with the end opposite the frame located vertically below the end adjacent the frame in the raised position.

4. The machine of claim 1 further comprising, in combination: a plurality of brushes carried by the frame in a longitudinally staggered arrangement and having a longitudinal extent; and a one piece squeegee having a U-shape including first and second legs integrally extending from the opposite ends of a central portion, with the first and second legs having free ends, with the squeegee having a longitudinal extent greater than the longitudinal extent of the brushes, with the brushes located in the squeegee intermediate the first and second legs and with the free ends of the first and second legs extending beyond the longitudinal extent of the brushes.

5. The machine of claim 4 further comprising, in combination: means for raising and lowering the one piece squeegee relative to the frame comprising, in combination: a lever having a first end and a second end, with the first end of the lever being pivotally mounted to the frame about a lever axis; means for connecting the squeegee to the second end of the lever for movement therewith; a first leg having a first end and a second end, with the first end of the leg being pivotally mounted to the frame about a leg axis, with the second end of the first leg abutting with the lever intermediate the first and second ends; and means for pivoting the first leg about the leg axis.

6. The machine of claim 5 wherein the pivoting means comprises, in combination: a second leg having a first end and a second end, with the first end of the second leg being interconnected to the first end of the first leg; and means for pivoting the second leg about the leg axis.

7. The machine of claim 1 further comprising, in combination: a squeegee; and means for raising and lowering the squeegee relative to the frame comprising, in combination: a lever having a first end and a second end, with the first end of the lever being pivotally mounted to the frame about a lever axis; means for connecting the squeegee to the second end of the lever for movement therewith; a first leg having a first end and a second end, with the first end of the leg being pivotally mounted to the frame about a leg axis, with the second end of the first leg abutting with the lever intermediate the first and second ends; and means for pivoting the first leg about the leg axis.

8. The machine of claim 7 wherein the pivoting means comprises, in combination: a second leg having a first end and a second end, with the first end of the second leg being interconnected to the first end of the first leg; and means for pivoting the second leg about the leg axis.

9. The machine of claim 8 wherein the leg axis is parallel to and spaced from the lever axis.

10. Machine for movement along a surface having debris comprising, in combination: a frame; a hopper for holding debris collected from the surface; and means for raising the bopper relative to the frame from a lowered position with the hopper in a horizontal debris collecting condition to a raised position with the hopper in a dumping condition and for simultaneously tilting the hopper as the hopper is raised from the lowered position to allow dumping of the debris from the hopper at multiple levels above the surface comprising, in combination: a first arm having a first end pivotally mounted to the frame and a second end; means for pivoting the first arm relative to the frame about the first end; a hopper arm having a first end pivotally mounted to the second end of the first arm and a second end pivotally mounted to the hopper; and means for pivotally mounting the hopper about a pivot axis spaced from the second end of the hopper arm and moveable along an arc when the first arm is pivoted relative to the frame.

11. The machine of claim 10 wherein the pivotally mounting means comprises, in combination: a second arm having a first end pivotally mounted to the frame spaced from the first end of the first arm and having a second end pivotally mounted to the hopper spaced from the second end of the hopper arm.

12. The machine of claim 11 wherein the pivotally mounting means further comprises, in combination: a rotation arm having a first end pivotally mounted to the first arm intermediate the first and second ends and having a second end pivotally mounted to the second arm intermediate the first and second ends.

13. The machine of claim 10 further comprising, in combination: a plurality of brushes carried by the frame in a longitudinally staggered arrangement and having a longitudinal extent; and a one piece squeegee having a U-shape including first and second legs integrally extending from the opposite ends of a central portion, with the first and second legs having free ends, with the squeegee having a longitudinal extent greater than the longitudinal extent of the brushes, with the brushes located in the squeegee intermediate the first and second legs and with the free ends of the first and second legs extending beyond the longitudinal extent of the brushes.

14. The machine of claim 13 further comprising, in combination: means for raising and lowering the one piece squeegee relative to the frame comprising, in combination: a lever having a first end and a second end, with the first end of the lever being pivotally mounted to the frame about a lever axis; means for connecting the squeegee to the second end of the lever for movement therewith; a first leg having a first end and a second end, with the first end of the leg being pivotally mounted to the frame about a leg axis, with the second end of the first leg abutting with the lever intermediate the first and second ends; and means for pivoting the first leg about the leg axis.

15. The machine of claim 14 wherein the pivoting means comprises, in combination: a second leg having a first end and a second end, with the first end of the second leg being interconnected to the first end of the first leg; and means for pivoting the second leg about the leg axis.

16. The machine of claim 15 wherein the leg axis is parallel to and spaced from the lever axis.

17. The machine of claim 10 further comprising, in combination: a squeegee; and means for raising and lowering the squeegee relative to the frame comprising, in combination: a lever having a first end and a second end, with the first end of the lever being pivotally mounted to the frame about a lever axis; means for connecting the squeegee to the second end of the lever for movement therewith; a first leg having a first end and a second end, with the first end of the leg being pivotally mounted to the frame about a leg axis, with the second end of the first leg abutting with the lever intermediate the first and second ends; and means for pivoting the first leg about the leg axis.

18. The machine of claim 17 wherein the pivoting means comprises, in combination: a second leg having a first end and a second end, with the first end of the second leg being interconnected to the first end of the first leg; and means for pivoting the second leg about the leg axis.

19. The machine of claim 18 wherein the leg axis is parallel to and spaced from the lever axis.

20. The machine of claim 10 wherein the hopper has an end opposite the frame and an end adjacent the frame, with the end opposite the frame including a dumping door, with the end opposite the frame located vertically below the end adjacent the frame in the raised position.

* * * * *